United States Patent [19]

Staples

[11] 4,362,804

[45] Dec. 7, 1982

[54] METHOD OF TONER TRANSFER WITH PULSE BIAS

[75] Inventor: Phillip E. Staples, Warradale, Australia

[73] Assignee: Coulter Systems Corporation, Bedford, Mass.

[21] Appl. No.: 269,775

[22] Filed: Jun. 3, 1981

[30] Foreign Application Priority Data

Jun. 3, 1980 [AU] Australia ..... PE3859

[51] Int. Cl.[3] ..... G03G 13/16

[52] U.S. Cl. ..... 430/126; 427/14.1

[58] Field of Search ..... 430/126; 427/14.1; 355/3 TR

[56] References Cited

U.S. PATENT DOCUMENTS 3,663,219 5/1972 Takahashi ..... 430/126 X
3,776,722 12/1973 Cantarano ..... 430/126
4,081,212 3/1978 Wetzer ..... 355/3 TR

FOREIGN PATENT DOCUMENTS 44403 1/1974 Australia ..... 430/126

OTHER PUBLICATIONS

Fletcher et al., "High Frequency Pulsed Bias Roller Transfer System", Xerox Discl. Jour., vol. 1, No. 5, May 1976, p. 83.

*Primary Examiner*—Roland E. Martin, Jr.
*Attorney, Agent, or Firm*—Silverman, Cass & Singer, Ltd.

[57] ABSTRACT

A method of electrically transferring an image deposit formed of liquid dispersed electroscopic toner particles from an image-bearing photoconductor surface of a recording member to the surface of an image-receiving member in which an electrical transfer bias voltage is applied through the interface between the said surfaces in a direction normal to the said surfaces, and in which the said electrical transfer bias voltage is applied intermittently by successive pulses of opposite polarity and with successively increasing voltage, with the final pulse of an electrical polarity and magnitude to transfer the said imaging material to the said receiving member.

13 Claims, No Drawings

METHOD OF TONER TRANSFER WITH PULSE BIAS

BACKGROUND OF THE INVENTION

Methods for the transfer of image deposits formed by electroscopic marking particles or toners of the liquid dispersed or dry type from the surface of a photoconductive or dielectric recording member to a receiving member surface are well known. Such methods may involve the use of corona generating means as is well known in electrophotographic office copying equipment and the like. Alternatively roller transfer methods may be used in which the toned recording member is contacted with the receiving member surface in the nip of a pair of rollers or in the nip formed between a roller and a flat plate. One roller or the flat plate of the nip pair is preferably conductive and grounded, whereas the second roller may have at least a relatively conducting surface which acts as a current limiting device when a transfer voltage is applied thereto. Such roller transfer methods are described for example in U.S. Pat. No. 3,862,848.

In the prior art methods previously referred to either the photoconductive or dielectric recording member or the receiving member comprises a paper web. Consequently in those instances in which so called liquid dispersed toners are used to image the recording member surface, the paper web allows movement of excess dispersant liquid away from the interface between the recording member and receiving member surfaces in such a manner that the electroscopic marking particles are not dislodged. However in those instances in which it is required to transfer an image deposit from a smooth and impervious recording member surface to a smooth and impervious receiving member surface, the prior art methods hereinbefore disclosed are not applicable as the image deposits are only held to the recording member surface by electrostatic forces associated with the electrostatic latent image and the flow or movement of surplus dispersant between the two members causes toner particles to be displaced laterally.

The present invention teaches a method whereby such disadvantages of prior art transfer methods in relation to transfer of image deposits from one smooth impervious surface to another may be overcome.

DESCRIPTION OF THE INVENTION

The present invention is particularly directed towards transfer of high resolution image deposits from a photoconductive or dielectric recording member surface to a transparent film, such as for instance a polyester film. High resolution image deposits may be formed for example on a smooth organic or selenium or cadmium sulfide photoconductor layer where such photoconductor layer is applied over a preferably transparent conductive layer onto a transparent film surface, such as a polyester film. We have found that when transfer of image deposits from such smooth and impervious photoconductors to a smooth and impervious receiving member is carried out in such a manner that excess dispersant liquid is removed in a stepped or gradual manner, transfer of the image deposit to the receiving member surface can be obtained without loss of resolution or definition.

The receiving member can be preferably a polyester film having on one side thereof a transparent conductive layer, such as an evaporated metal layer, preferably of gold or aluminium or indium-tin oxide or the like. Additionally, such conductive layer may be of a temporary nature, such as a polyelectrolyte resin as for example the quaternary ammomium type, which layer is removable after transfer of the image deposit to the opposite surface of such receiving member.

The following is a detailed description of a preferred embodiment of the invention.

An image deposit was produced by attracting liquid dispersed toner material to a latent image formed by negative electrostatic charges on the surface of a photoconductive recording member of the type described in the foregoing.

The photoconductive recording member carrying the still wet image deposit was then laid face up on a conductive grounded backing member, such as a metal plate, and the conductive layer beneath the photoconductor on the recording member was electrically connected to the grounded backing member.

A 0.005 inch thick polyester film having a vacuum evaporated transparent gold layer on one side thereof, was wetted with dispersant liquid such as isaparaffinic hydrocarbon and the wetted side was laid on the image bearing recording member, the gold surface of such image receiving member being uppermost, that is away from the interface between the two members forming a sandwich.

The conductive gold layer on the upper surface of the receiving member was connected to one terminal of a reversible high voltage DC power supply, the other terminal of which was grounded.

A potential of 500 volts negative was applied to the conductive gold layer of the receiving member. This caused the receiving member to move towards the recording member which in turn caused some reduction of the dispersant volume at the interface and the thus displaced dispersant drained away from the sandwich.

The applied voltage was then reversed to 500 volts positive. This caused further movement of the receiving member towards the recording member, thus displacing a further quantity of dispersant liquid.

The voltage was then raised to 800 volts positive, causing further displacement of dispersant liquid.

The voltage was then reversed to 800 volts negative and immediately raised to 1000 volts negative. At this stage the receiving member was in intimate contact with the recording member.

The high voltage power supply was then switched off and the receiving member separated from the recording member. Virtually complete image transfer had occurred with no lateral displacement of toner particles.

It will be realised that as each of the above disclosed recording member and receiving member are flexible, the positions of the two members may be reversed, that is the receiving member may be positioned on the conductive base member, conductive side down, and the image bearing photoconductive recording member may be laid thereon, image side down. The high voltage power supply would then be connected to the conductive layer of the photoconductive recording member. Stepped voltage application would be as previously described with the exception that all polarities would be reversed in comparison with the previous detailed description.

It will be noted that in the above disclosed transfer procedure the toner material comprised so-called positive electroscopic marking particles which formed deposits by attraction to negative latent image charges on the photoconductor surface. To transfer such toner deposits from the photoconductor surface to the receiving member surface it is therefore necessary to apply a negative that is attracting voltage to the conductive layer of the receiving member and a positive that is repelling voltage to the conductive layer of the photoconductor. Thus it will be seen that the 500 volts negative first applied to the conductive layer of the receiving member attracted to toner deposit at least in part to the receiving member whereas the subsequently applied positive potential of 500 volts and then 800 volts repelled the toner deposits from the receiving member. The actual image transfer to the receiving member was effected by the final application of the attracting negative potential of 800 volts and then 1000 volts.

Without wishing to be bound by any theory, the mechanism of the above disclosed transfer process involving stepwise removal of dispersant liquid from the interface could be explained as a capacitance effect that is to say particle mobility within a thin dielectric liquid layer contained at the interface between two dielectric plates of a capacitor which is charged, discharged and then again charged in reverse direction with regards polarity. Each time the capacitor plates acquire a certain charge level, they are attracted towards each other and displace laterally some of dispersant liquid contained at their interface while the image deposits also contained at the interface do not move laterally because as they are formed by polarity sensitive electroscopic marking particles they move in a direction normal to the capacitor plates that is in the direction of the electrostatic field lines extending between said plates, provided of course the forces associated with such field line intensity preventing lateral movement of the toner particles is higher than the lateral forces associated with the flow of the dispersant liquid as it is being displaced from the interface.

Thus it will be seen that the transfer process in accordance with this invention consists in stepwise reduction of the dispersant liquid volume contained at the interface between two impervious surfaces by controlled attraction of such surfaces towards each other, maintaining an electrostatic field between such surfaces to prevent lateral movement of electroscopic particles contained therebetween while said dispersant liquid is being laterally removed and upon reduction of said dispersant liquid volume to a predetermined level transferring said electroscopic particles to the receiving member surface. We have found that the number of steps required to reduce the dispersant liquid volume without laterally dislodging the electroscopic particles, the duration of such steps, the voltage levels and polarities applied during such steps and final transfer voltage level depend mainly on the nature of the electroscopic particles forming the image deposits, the volume of dispersant liquid initially present at the interface, the resistivity, dielectric constant, thickness, size and surface properties of the recording member and of the receiving member as well as on the nature of the conductive layers forming part of the recording and receiving members. Such characteristics of the components employed establish what may be called the time constant of the system, according to which the variable factors such as voltage levels, polarities, number and duration of steps, transfer voltage, etc. can be defined from case to case to suit specific systems to best advantage.

The claims defining the invention are as follows:

1. A method of electrically transferring an image deposit formed from a liquid developer comprising electroscopic toner particles dispersed in an electrically insulating carrier liquid, from a smooth image-bearing photoconductor surface of a recording member to a smooth surface of an image-receiving member having a non-conductive side and in which the image-bearing surface of the recording member is placed into contact with the image-receiving surface of the non-conductive side of the said image-receiving member, the image-recording and image-receiving members being impervious to the carrier liquid of the liquid developer and an electrical transfer bias voltage is applied through the interface between the said surfaces in a direction normal to the said surfaces, characterised in that the said electrical transfer bias voltage is applied intermittently by successive pulses of opposite polarity and with successively increasing voltage gradually progressively to remove excess liquid from the interfaced surfaces, while the final pulse being of an electrical polarity and magnitude sufficient to transfer the said image deposit to the said receiving member.

2. A method of electrostatically transferring an image deposit formed of electroscopic toner particles from a liquid developer comprising electroscopic toner particles dispersed in an electrically insulating carrier liquid from the image-bearing smooth photoconductor surface of a recording member to the smooth surface of a receiving member while removing excess liquid developer therebetween, the recording and receiving members being impervious to the carrier liquid, said method comprising the steps of:

(A) providing a receiving member having a non-conductive side and an electrically conductive thin coating on a surface thereof, (B) positioning one of the recording and receiving members on a conductive surface base, (C) effecting a physical interface between the non-conductive side of said receiving member and said recording member with the conductive coating of said receiving member spaced from said interface, (D) applying a first bias voltage across said interface, selecting said bias voltage to be of value and polarity to effect movement of said receiving member toward the recording member, (E) applying a second bias voltage across said interface with said second bias voltage being at least of the value of said first bias voltage but of opposite polarity relative thereto, (F) repeating said first and second bias voltage applications for at least an additional cycle but at an increased voltage value, to bring said image-bearing and receiving members progressively closer to effect removal of excess liquid developer therebetween, (G) the final application of bias voltage being of a polarity and magnitude sufficient to transfer the image deposit to said receiving member and (H) separating said receiving and recording members, there being complete image transfer across said interface from said recording member to said receiving member in the absence of lateral displacement of the toner particles.

3. The method as claimed in claim 2 in which there are more than two cycles of bias voltage application with the voltages increased for each cycle.

4. The method as claimed in claim 2 wherein the receiving member is placed conductive side down on the conductive base surface and the recording member is placed image-bearing side down on the receiving member to establish said interface.

5. The method as claimed in claim 2 wherein the toner image carried on the recording member is wet with insulating toner carrier liquid.

6. The method as claimed in claim 2 wherein the side of the receiving member forming the interface is wetted with a layer of dispersant liquid.

7. The method as claimed in claim 2 wherein the voltage values of each bias voltage application cycle is increased for each cycle.

8. The method as claimed in claim 2 wherein the toner particles are negatively charged and the polarity of the first applied bias voltage is negative and the second applied bias voltage has a positive polarity.

9. The method as claimed in claim 3 wherein the toner particles are positively charged and the first applied bias voltage has a positive polarity and the second applied bias voltage has a negative polarity.

10. The method as claimed in claim 2 wherein the conductive coating is transparent.

11. The method as claimed in claim 2 wherein the conductive coating is formed of vacuum evaporated gold bonded to the surface of an electrically insulating substrate.

12. The method as claimed in claim 2 wherein there is a layer of a dielectric liquid at the interface.

13. The method as claimed in claim 2 and the step of wetting at least one of the interfacing surfaces with dispersant liquid.

* * * * *